US007093715B1

(12) United States Patent
Apps

(10) Patent No.: US 7,093,715 B1
(45) Date of Patent: Aug. 22, 2006

(54) NESTABLE CAN TRAY WITH CONTOURED WALL STRUCTURE

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 844 days.

(21) Appl. No.: 09/780,073

(22) Filed: Feb. 9, 2001

Related U.S. Application Data

(63) Continuation of application No. 09/233,082, filed on Jan. 19, 1999, now Pat. No. 6,186,328, which is a continuation-in-part of application No. 29/068,737, filed on Mar. 31, 1997, now Pat. No. Des. 404,204.

(51) Int. Cl.
*B65D 21/032* (2006.01)

(52) U.S. Cl. ..... 206/518; 206/564; 206/821; 220/509

(58) Field of Classification Search ..... 206/509, 206/511, 512, 821, 515, 518, 519, 562, 563, 206/564; 220/509, 513, 516, 517
See application file for complete search history.

(56) References Cited

U.S. PATENT DOCUMENTS

| | | | | | |
|---|---|---|---|---|---|
| 3,091,355 | A | * | 5/1963 | Mutto | 206/505 |
| 3,503,521 | A | * | 3/1970 | Rogus | 206/505 |
| D239,213 | S | | 3/1976 | Carroll | |
| 4,079,077 | A | * | 3/1978 | David | 206/518 |
| 4,238,032 | A | * | 12/1980 | Thurman | 206/518 |
| D266,198 | S | | 9/1982 | Carroll et al. | |
| 4,932,532 | A | | 6/1990 | Apps et al. | |
| D313,493 | S | | 1/1991 | Apps et al. | |
| D317,670 | S | | 6/1991 | Apps | |
| D319,908 | S | | 9/1991 | Stahl | |
| D329,932 | S | | 9/1992 | Apps | |
| 5,184,748 | A | | 2/1993 | Apps | |
| 5,230,601 | A | | 7/1993 | Apps et al. | |
| 5,267,649 | A | | 12/1993 | Apps et al. | |
| 5,305,884 | A | | 4/1994 | Apps et al. | |
| 5,316,172 | A | | 5/1994 | Apps et al. | |
| 5,323,925 | A | | 6/1994 | Apps | |
| D355,764 | S | | 2/1995 | Apps | |
| D356,679 | S | | 3/1995 | Apps et al. | |
| 5,415,293 | A | | 5/1995 | Ackermann et al. | |
| D361,663 | S | | 8/1995 | Kalin | |
| 5,445,273 | A | | 8/1995 | Apps | |
| 5,487,487 | A | * | 1/1996 | Hammett | 220/509 |
| 5,493,945 | A | | 2/1996 | Matsumura | |
| 5,575,390 | A | | 11/1996 | Apps et al. | |
| D379,121 | S | | 5/1997 | Apps et al. | |
| D381,203 | S | | 7/1997 | Ackermann et al. | |
| 5,752,602 | A | | 5/1998 | Ackermann et al. | |
| D400,012 | S | | 10/1998 | Apps | |
| D401,066 | S | | 11/1998 | Ackermann | |
| D404,204 | S | * | 1/1999 | Apps | D3/314 |
| 5,881,902 | A | | 3/1999 | Ackermann | |
| 6,186,328 | B1 | * | 2/2001 | Apps | 206/518 |

* cited by examiner

*Primary Examiner*—Stephen Castellano

(57) ABSTRACT

A light weight low depth nestable tray for containers comprising an open lattice floor structure and a wall structure that is contoured to reduce the amount of material used for the tray. The wall structure comprises a plurality of columns interconnecting the floor to a band that is generally spaced above the floor and extends around the periphery. The band is contoured at a number of points along the periphery of the tray to reduce the number of columns as compared to the prior art trays which generally have columns at each of the corners and along the end walls and side walls. The reduction in the number of columns reduces the weight of the tray and therefore is more economical. The contour is V-shaped and the band actually connects directly to the floor at those points. The contoured wall structure provides a lighter tray that can be stacked, nested and handled in the same way as prior trays and while maintaining the structural integrity of the bulkier, heavier trays.

28 Claims, 7 Drawing Sheets

NESTABLE CAN TRAY WITH CONTOURED WALL STRUCTURE

REFERENCE TO RELATED APPLICATIONS

This application is a continuation of Ser. No. 09/233,082, filed Jan. 19, 1999, now U.S. Pat. No. 6,186,328, which is a continuation-in-part of application Ser. No. 29/068,737, filed Mar. 31, 1997, now design patent No. D 404,204, which is incorporated herein by reference.

BACKGROUND OF THE INVENTION

The present invention relates to a low depth, nestable tray for transporting and storing beverage containers having substantially equal diameters, such as twelve-ounce aluminum beverage cans. Cans for soft drinks, beer and other beverages are often stored and transported during the distribution stages thereof in trays or boxes. These trays or boxes are also used in the retail setting to display the cans, typically in a stack of loaded trays or boxes. Can trays made of plastic are frequently used since they are reusable and recyclable and do not contribute to the solid waste problem of cardboard or paperboard boxes.

Plastic trays wherein the side walls are lower than the height of the stored containers are referred to as low depth trays. Since containers placed in the cases would extend above the side walls, the containers in a lower case support the weight of the other cases stacked on top of them. Metal cans generally have the structural integrity to bear the compressive loads of loaded and stacked trays.

Many prior can trays are configured to be nestable with one another when they are empty to reduce the amount of space they take up during transport back to a wholesaler or bottler. Examples of returnable and reusable can trays are disclosed in U.S. Pat. Nos. 4,932,532; 4,823,955; 5,031,774 and 5,445,273. These prior patents are assigned to the same assignee as the present application, and their disclosures are hereby incorporated by reference. The trays disclosed in these prior patents comprise a floor, a band spaced from the floor and a plurality of columns interconnecting the floor and band. In general, the columns are arranged at the corners and along the end walls and side walls of the trays.

Previous can trays have vertical columns or pillars provided between every two container rest areas. It has been found that the column and band construction of prior trays interfere with handling of cans that are bundled together with a secondary packaging such as an overwrap or paperboard wrap. The corners and the longer side walls present the most critical areas in which interference with secondary packaging has been experienced. There is a need for a tray that is structurally sound but whose construction does not interfere with secondary packaging.

Can trays must also have sufficient structural integrity and strength so that the wall structure can resist spreading or fraying of side wall structures when a large number of empty trays are nested. The side walls of trays near the bottom of a nested stack bear more of the weight of the nested stack, and have a tendency to spread or splay outward. This damage has a cumulative effect and results in a shorter service life for the trays, and thus additional expense for replacement.

Another aspect of can tray construction is the provision of structural supports for the cans on the floor of the tray to retain the cans in spaced relation to one another and the wall structure. Excessive jostling of loaded cans can cause damage to the cans ranging from slight scratches to more severe dents and even ruptures. Simply the operating vibration of a truck containing the loaded trays can cause damage to the cans if there is excessive contact and rubbing between the tray walls and the cans.

Since can trays that are loaded with cans are stacked on top of one another, can trays include downwardly extending elements on the bottom of the floor surface to aid in stable stacking and movement of stacks. These downward elements are arranged so that some are placed within the top rims of cans in a loaded tray there beneath, and others are placed between top rims of adjacent cans in the lower loaded tray.

While prior art trays for beverage cans have addressed some of the problems of can handling and stack stability, typically the results have been trays that are relatively bulky and heavy which adds to transportation costs and increases the handling burden of handling stacks of loaded trays. There has been a need for a lighter tray which provides all of the structural features and advantages.

SUMMARY OF THE INVENTION

Accordingly, it is a principal object of the present invention to provide a nestable, low depth tray for storing, displaying and transporting containers that is light weight but still provides the necessary structural integrity and strength for repeated use and handling.

Another object of the invention is to provide a wall structure that does not interfere with secondary packaging over cans.

A further object of the present invention is to provide a low depth, nestable tray which has sufficient structural features to prevent the side walls of the tray from spreading or fraying due to the weight of trays nested above it.

Yet another object of the present invention is to provide a tray that has straight wall portions at the corners so that the outside dimensions of the tray at both the top and bottom of the tray are the same to facilitate tray handling by automated equipment.

A further object of the present invention is to provide a low depth tray which is securely supported when loaded and stacked on another loaded tray beneath, but can easily be moved along the tops of the containers, particularly can tops.

A still further object of the present invention is to provide a low depth nestable tray which makes efficient use of space both when loaded and stacked and when empty and nested.

Another object of the present invention is to provide a low depth, nestable tray which holds the containers spaced apart from one another and from the wall structure of the tray to prevent any damage to the containers from excessive contact.

Directed to achieving these objects, a new, light weight low depth, nestable tray for containers is herein provided. The preferred configuration is for single serve sized cans. This tray is formed by integrally molding from plastic, two basic components a wall structure and a floor.

The wall structure is contoured, substantially upright and extends around the periphery of the tray. The wall structure is of a low depth configuration, that is, lower than the tops of the loaded cans, but high enough to prevent the cans from tipping. The wall structure comprises a band that extends around the periphery and a plurality of columns that interconnect the band to the floor at certain points. The band is contoured at a number of points along the periphery of the tray to reduce the number of columns as compared to the prior art trays which generally have columns at each of the corners and along the end walls and side walls. The reduction in the number of columns reduces the weight of the tray and therefore is more economical. The contour is V-shaped and the band actually connects directly to the floor at those points. The contoured wall structure provides a lighter tray that can be stacked, nested and handled in the same way as prior trays and while maintaining the structural integrity of the heavier trays. Each of the four corners of the tray also has contoured V-shaped walls. The V-shaped walls, besides reducing the weight of the tray, provide interior surfaces that do not interfere with secondary packaging around cans, and also ensure that the top and bottom outside dimensions of the tray are the same.

The floor preferably has an open lattice construction which not only allows unwanted fluids to drain out of the tray, but also requires less material and thus is lighter than a solid floor design. The floor also has container support areas sized to receive cans, and includes a shallow groove for engaging the bottoms of cans of varying bottom rim diameter. The floor of the tray has an outer or bottom surface which is configured for accommodating the tops of cans in a tray underneath. The floor bottom surface preferably has two sets of downwardly projecting redoubts, one set which are located to be disposed within the top rims of cans in a tray therebeneath and a second set which are located to be disposed between the top rims of adjacent cans in a tray therebeneath. The redoubts also block a tray from sliding along the tops of cans in a tray underneath it.

These and other features and advantages of the invention may be more completely understood from the following detailed description of the preferred embodiments of the invention with reference to the accompanying drawings.

DETAILED DESCRIPTION OF THE PREFERRED EMBODIMENT

Figure 1:
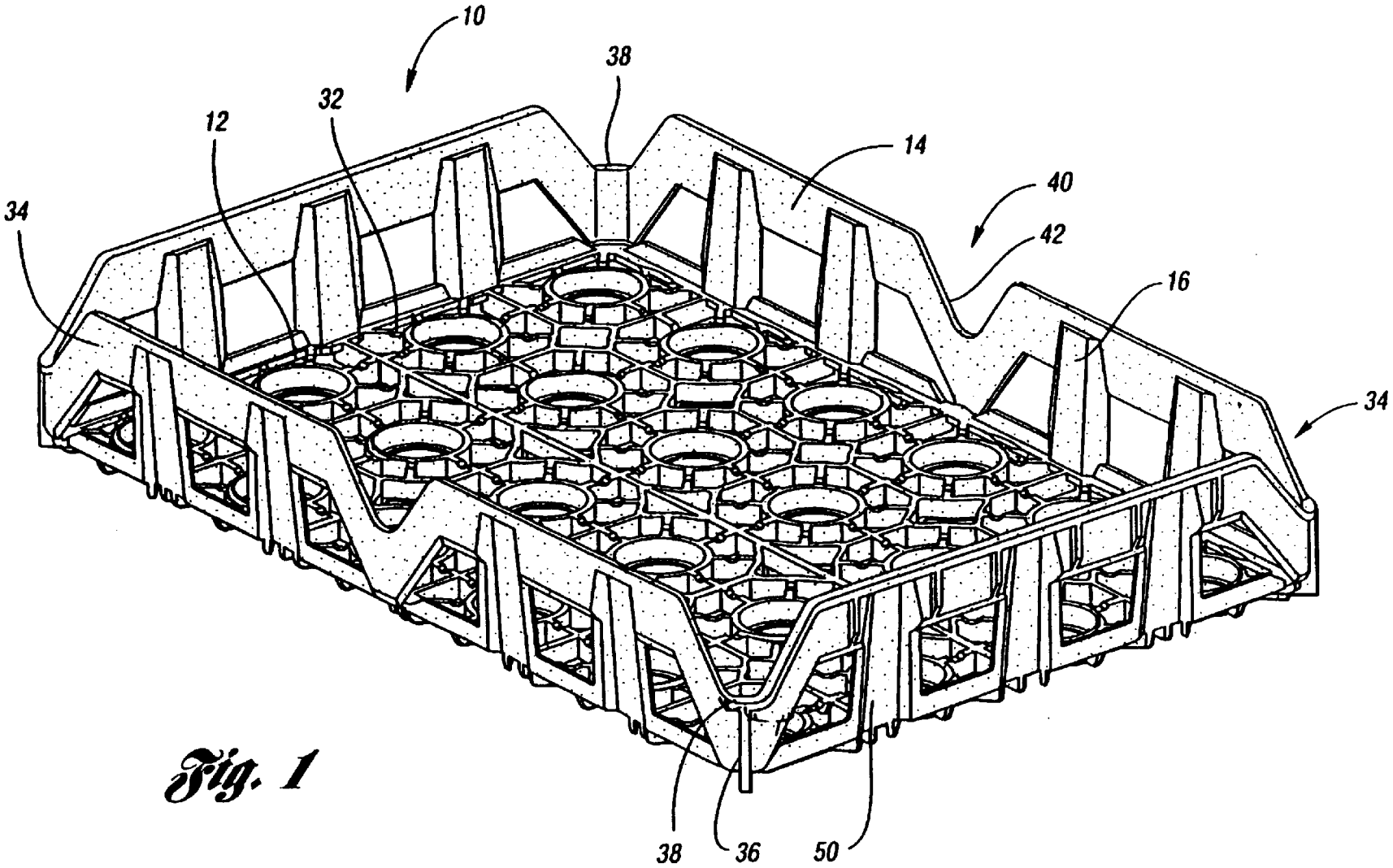
FIG. 1 is a top perspective view of a tray in accordance with the present invention.

Referring to FIGS. 1–5, tray 10 of the preferred embodiment comprises a floor 12 and a wall structure comprising a band 14 and columns 16. Columns 16 are generally arranged between container support areas so that the containers will be visible between the columns.

Floor 12 has an open lattice construction with comprising an array of circular elements 18 with diamond shaped elements 20 disposed in between the circular elements. Circular elements 18 and diamond elements 20 are interconnected by struts 22, 24, 26, 28 that traverse the floor lengthwise, widthwise and in both directions diagonally, respectively. The circular elements define container support areas 30 arranged in a four-by-six array. For convenience of explanation, the short sides of the tray will be referred to as the ends and the long sides will be referred to as the sides. It will be understood throughout the disclosure that the four-by-six size is the preferred embodiment and any rectangular or square arrangement is contemplated to be within the scope of the invention.

Figure 5:
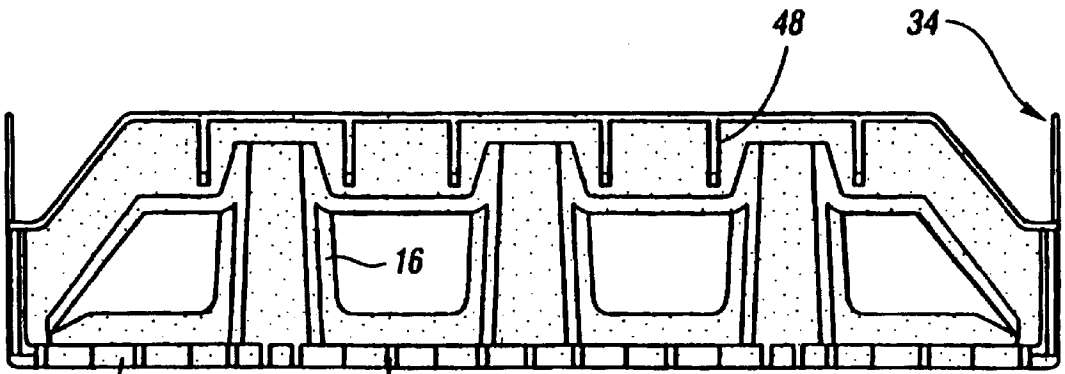
FIG. 5 is an end elevational view of the tray of FIG. 1.
Figure 6:
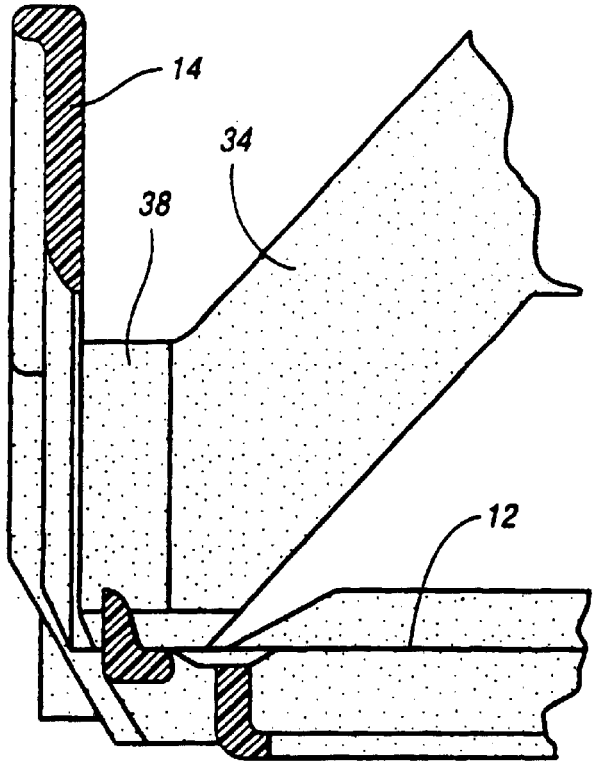
FIG. 6 is a cross-sectional view of the tray taken along line 6—6 of FIG. 2.

As best seen in FIGS. 5 and 6, container support areas 30 each define a container rest comprising an arrangement of grooves 32 provided in the lattice struts immediately adjoining the circular lattice elements. The grooves will engage the bottom of a container placed thereon to "seat" the container. These grooves ensure that the individual containers area properly seated when loaded trays are stacked together. This positive engagement results in a more stability when handling and storing stacked loaded trays of cans. In addition, excessive movement of the containers within a tray is prevented which reduces the risk of damage to the cans.

Figure 2:
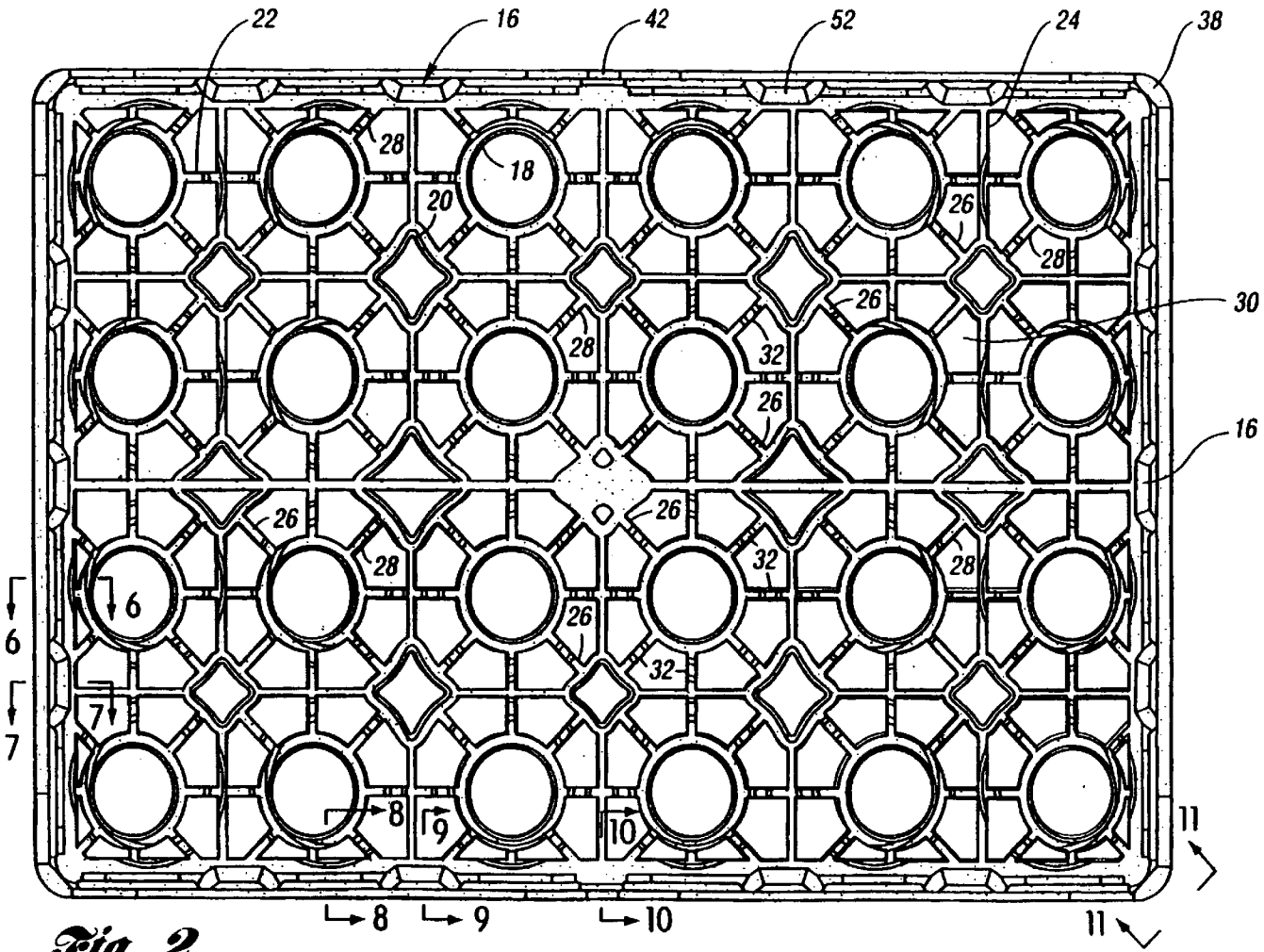
FIG. 2 is a top plan view of the tray of FIG. 1.

On the bottom surface of the floor, circular elements 18 and diamond elements 20 extend downward slightly relative to the straight struts. This is best seen in FIGS. 1 and 2 where there is a step shown between the bottom of the struts and the bottoms of the circular and diamond elements. The slight downward extension of these elements, particularly circular elements 18, results in a locking relationship between the downward elements or redoubts and the container rims in a lower tray when loaded trays are stacked with one another. In this manner, stacked loaded trays cannot easily move relative to one another which is safer for transporting and handling stacked trays.

The wall structure of tray 10 is constructed to retain structural integrity and strength but reduce the amount of material. Less material reduces production costs and well as transportation costs since the result is lighter weight trays. Band 14 extends along the periphery of the floor and is generally spaced upward from the floor. In the areas that band 14 is spaced above floor 12, columns 16 interconnect the band to the floor. Band 14 is substantially smooth along its interior surface which is generally flat. The interior surface of band 14 is not scalloped in any way so as to avoid excessive contact with the containers when tray 10 is loaded. Band 14 is flexible so as to flex upon impact and thereby prevent the containers from being substantially affected by external forces.

Figure 11:
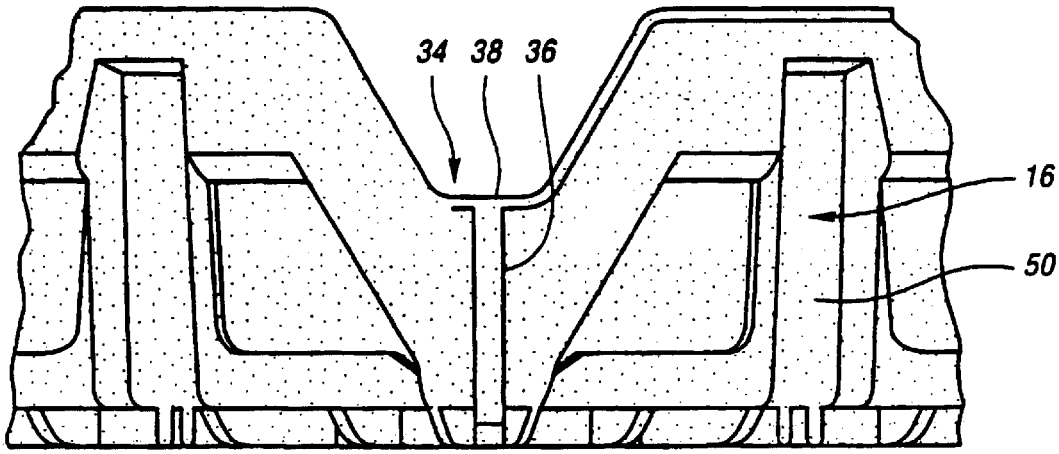
FIG. 11 is a detailed elevational view of a corner of the tray indicated by line 11—11 of FIG. 2.

To reduce the number of columns and therefore the amount of material used for the tray, band 14 is angled downwardly from the horizontal or contoured in certain areas to contact the floor itself. In this preferred embodiment, corner columns have been eliminated by contouring band 14 downward at the corners of the wall structure into angled V-shaped corner portions 34. As best seen in FIGS. 1 and 11, a reinforcement rib 36 is provided on the exterior surface of each corner portion 34. Directly above each reinforcement rib 36 is a nesting platform 38 which supports the bottom of a corner reinforcement rib in a tray nested above. This reinforced support of the corners of above-nested trays helps to prevent the side walls from fraying or splaying outward due to the load of nested trays.

Figure 3:
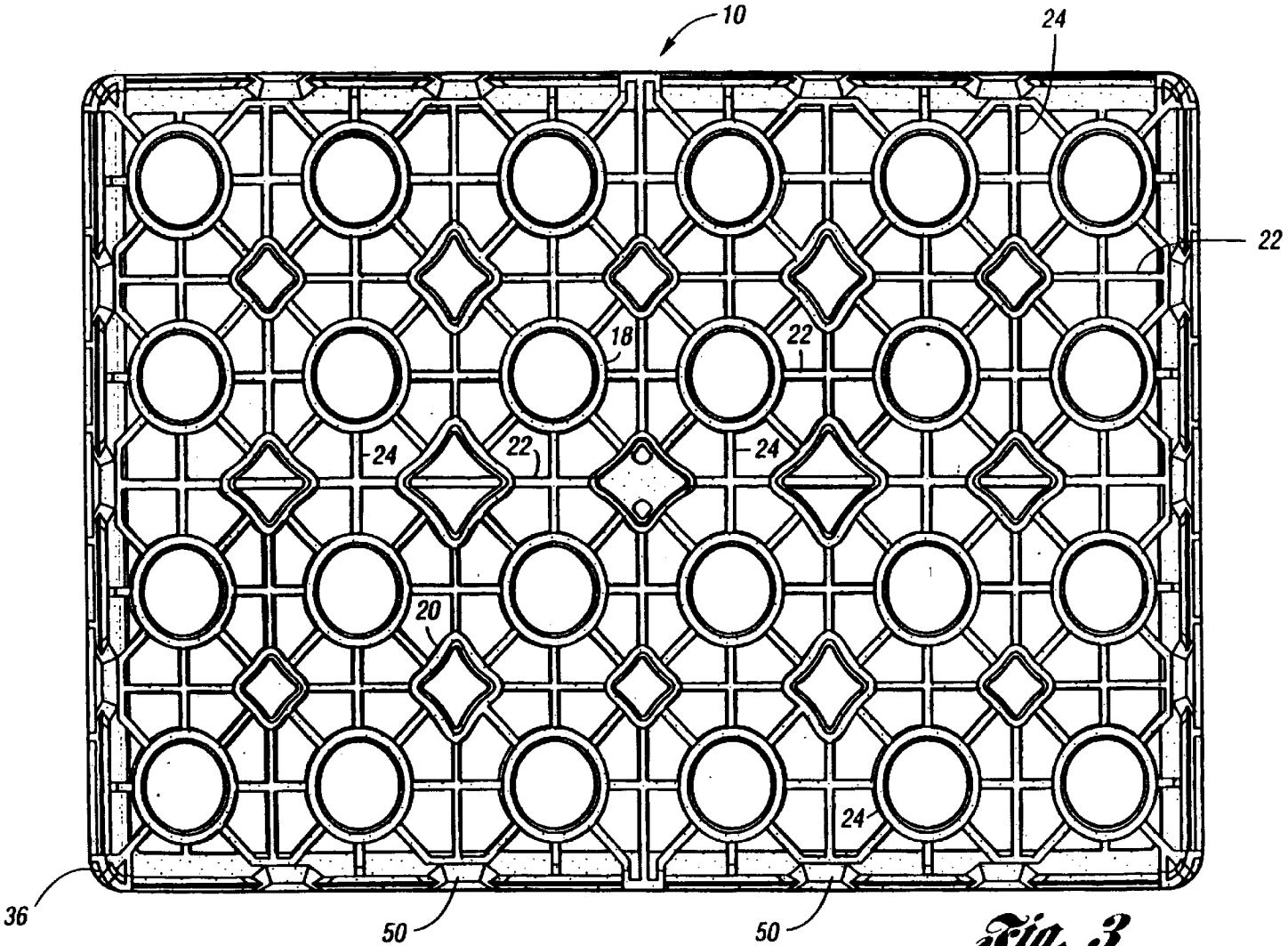
FIG. 3 is a bottom plan view of the tray of FIG. 1.

One of the advantages of V-shaped corner portions 34 is that this construction allows the outside dimensions of the tray top and bottom to be the same. FIGS. 2 and 3. That is, the top footprint of the tray is the same as the bottom footprint, there are no outwardly spread walls as in the prior art. The equal outside dimensions of both the top and bottom of the tray make handling of the tray by automated equipment easier.

The downward slopes of the end wall portion of band 14 and the side wall portion of band 14 to form corner portions 34 also provides more visibility of the cans which is advantageous in a retail setting. FIG. 11.

Figure 4:
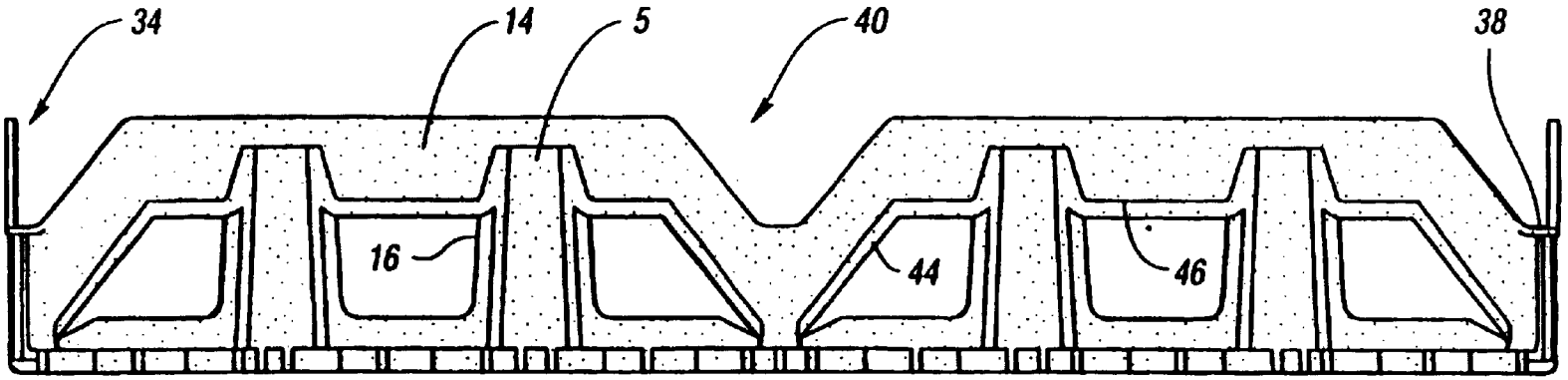
FIG. 4 is a side elevational view of the tray of FIG. 1.
Figure 10:
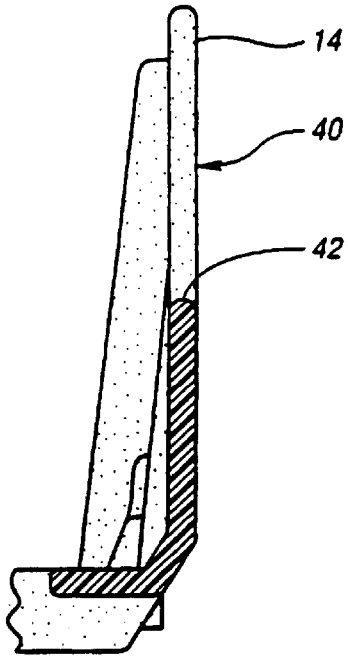
FIG. 10 is a cross-sectional view of the tray taken along line 10—10 of FIG. 2.

More columns are eliminated in the preferred embodiment by contouring band 14 in the center of each of the side walls. FIG. 4. Band 14 along each of the side walls is contoured downward into V-shaped central portions 40 which connect directly to floor 12. Each central portion 40 takes the place of a column which is a substantial reduction in the amount of material comprising the tray. The concave top edge of each central portion 40 has a nesting surface 42 which is configured to support the bottom surface 44 of a V-shaped central portion in a nested tray thereabove. In this manner, contoured central portions 40 of nested adjacent trays are mated together with the lower tray supporting the upper tray. FIG. 10.

In both the corner portions and the central portions, the preferred angle at which the band angles downward is between 30° and 60°. As used herein, "contoured" is intended to be a broader term than "angled." While the V-shaped portions are shown and disclosed, other suitable shapes for the contoured band are contemplated to be within the scope of the invention.

Another advantage of the V-shaped portions of the walls is that they do not interfere with secondary packaging around multi-packs of cans. This is a significant benefit when multi-packs are handled since the secondary packaging will not be damaged.

To facilitate handling of the trays, the contoured band portions must be symmetrically placed so that trays can be easily nested without regard to their orientation relative to one another.

Figure 7:
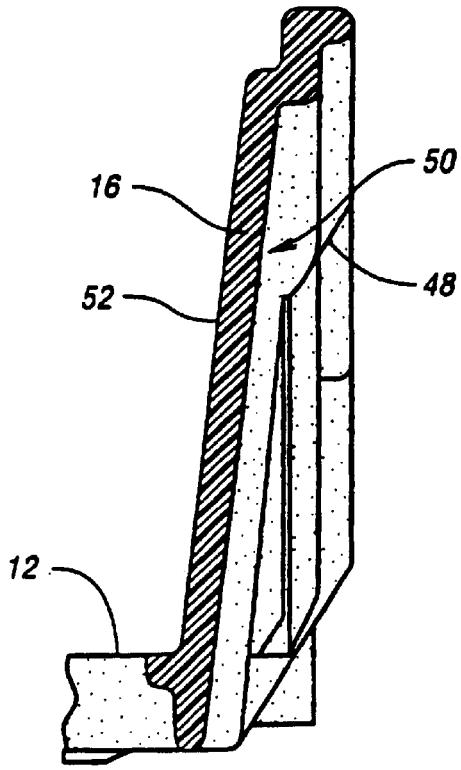
FIG. 7 is a cross-sectional view of the tray taken along line 7—7 of FIG. 2.
Figure 8:
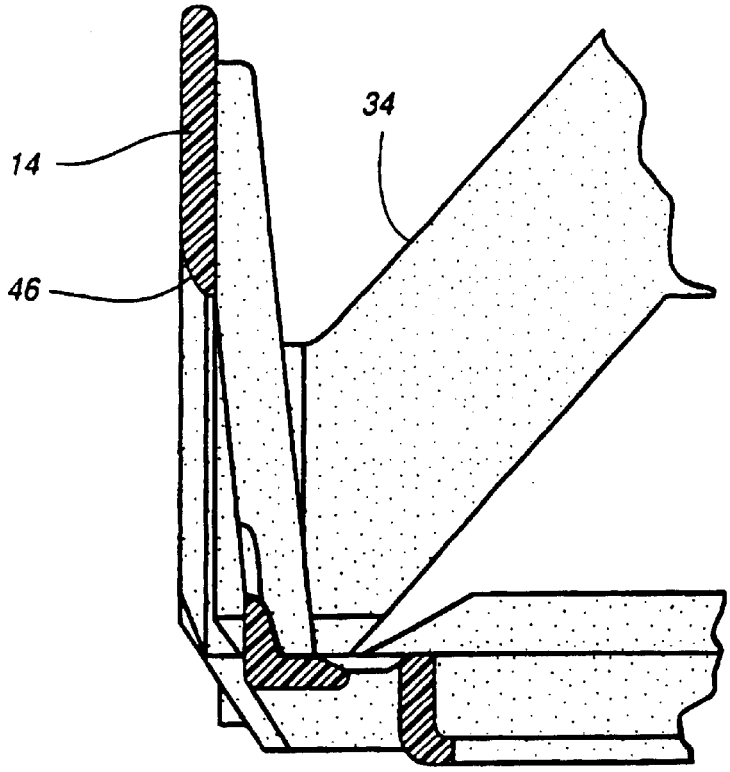
FIG. 8 is a cross-sectional view of the tray taken along line 8—8 of FIG. 2.

The lower portion of the exterior surface of band 14 has a smooth, downwardly and inwardly inclined beveled or cam surface 46 along the side walls. FIG. 8. Along the end walls, the exterior surface of band 14 is provided with ribs 48 that are also downwardly and inwardly inclined. FIG. 7. These inclined surfaces are important to preventing the shingling problems of previous trays. The camming surfaces operate against the a lip or top edge of an adjacent tray and tends to make the tray drop down without resting on the adjacent top edge. Such beveled surfaces avoids providing a catch surface that is prevalent in trays that have shingling problems.

Columns 16 are spaced around the periphery of the floor and interconnect floor 12 to band 14. The areas between the adjacent columns and between the band and floor along the sides are open, providing a light weight design allowing for visualization and display of the containers held in the tray. The column height is that it is designed to hold the band far enough above the floor of the tray to enable a UPC code on a can contained in the tray to be read through the space between the columns. The height of columns 16 is sufficient enough to prevent the containers from tipping when transported and handled, and low enough so that the tops of the containers extend above band 16 and a stack of nested trays take up minimal vertical space.

Figure 9:
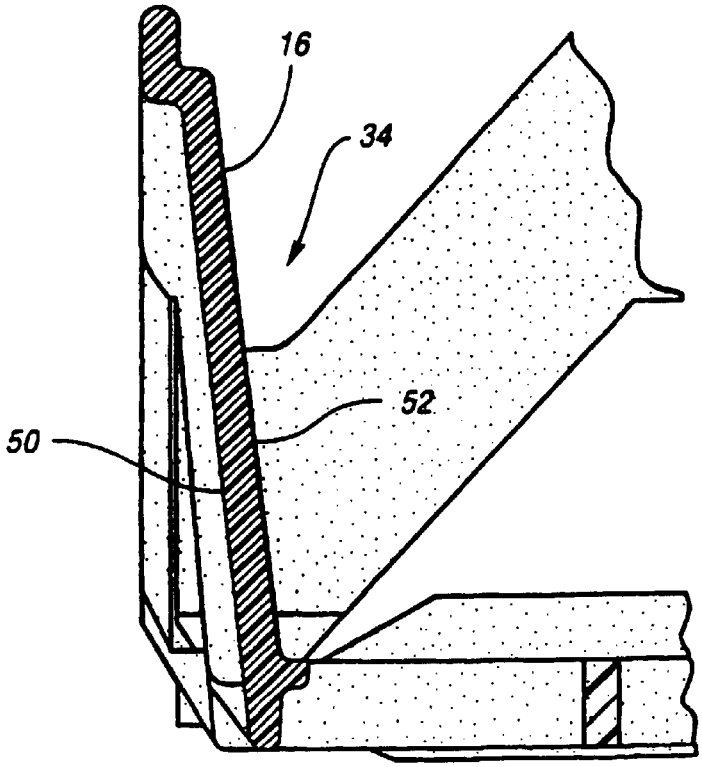
FIG. 9 is a cross-sectional view of the tray taken along line 9—9 of FIG. 2.

The exterior surfaces of columns 16 include slots 50 which also define the inward surfaces 52 of the columns. FIGS. 4 and 9. Slots 50 are configured to receive inward surfaces 52 of the columns of a tray nested above. Inward surfaces 52 are generally vertical and preferably have three angled faces which mate in the corresponding slots with mating angled surfaces. Columns 16 must be substantial enough to support band 14 so that the tray does not break apart when the containers push against the band. The columns preferably have the pyramidal design shown in the drawings allowing them to have the largest area at their bottoms and thus making it unlikely that they will be tom away from the floor in the event of a severe impact. By placing columns 16 between the container support areas excessive contact with the containers during normal tray handling, and any resultant damage, is avoided.

When the trays are nested, since nesting platforms 38 support ribs 36 at the corners of the tray, end walls and side walls are relieved of the nested load and consequently are not as prone to splaying outward or fraying. Thus the trays of the present invention maintain their structural integrity and will have a longer service life. Moreover, controlling the spreading or fraying of the wall structures lessens the chances of shingling.

The tray of the present invention is contemplated to be used with loose cans as well as those wrapped or otherwise bound into six-packs or twelve-packs. The floor and wall structures are constructed so that they will not interfere with wraps or other binding means around multi-packs of cans.

The preferred embodiment of the present invention comprises downward contours of the band at the corners and in the central area of the side walls, but any configuration of columns and downward contours are contemplated to be within the scope of the invention. As long as the desired strength of the tray is maintained, any number of the columns may be eliminated and replaced with downward contours as disclosed herein.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited only by the claims appended hereto.

What is claimed is:

1. A low depth nestable tray for containers, said tray a floor structure with a floor top surface, a floor bottom surface, and a plurality of container support areas on the floor top surface, wherein the improvements comprise:

a low depth wall structure comprising a plurality of columns arranged along the periphery of the floor structure, and further comprising a band having side and end portions spaced above the floor structure and connected to the floor structure by said columns to form a unitary construction, wherein said band is contoured downwardly to form a band corner portion that directly connects to the floor structure at each corner of said tray, and wherein an uppermost edge of the corresponding band corner portion is an uppermost surface of the wall structure at the corresponding band corner portion and wherein the upper edge of the band corner portion is below uppermost surfaces of the side and end portions.

2. The tray of claim 1, wherein each said band corner portion is formed whereby one said side portion of said band is contoured downwardly and one said end portion is contoured downwardly so as to converge together.

3. The tray of claim 2, further comprising a rib on an exterior surface of each said band corner portion, and platform formed at a top edge of each said band corner portion to support the rib of an above-nested tray.

4. The tray of claim 1, wherein said band is contoured downwardly at an angle of approximately 50°.

5. The tray of claim 1, wherein said band is also contoured downwardly along the side of said tray to form a band side detail that connects to the floor structure at the side of said tray.

6. A low depth nestable tray for containers, said tray having a floor structure with a floor top surface, a floor bottom surface, and a plurality of container support areas on the floor top surface, wherein the improvements comprise:

a low depth wall structure comprising a plurality of columns arranged generally perpendicularly to the floor structure along the periphery of the floor structure, and further comprising a band having side and end portions spaced above the floor structure and connected to the floor structure by said columns to form a unitary construction, wherein said band includes parallel portions generally parallel to the floor structure and is contoured downwardly along the side portions between the parallel portions to form a band central portion that directly connects to the floor structure at the side portions of said tray.

7. The tray of claim 6, wherein said band central portion has a top edge for contacting and supporting a mating bottom edge of the band central portion of a like tray nested thereabove and wherein the top edge of the band central portion is the uppermost surface of the wall structure at the band central portion.

8. The tray of claim 6, wherein said band is contoured downwardly at an angle of approximately 50° to form said band central portion.

9. The tray of claim 6, wherein the band also contours downwardly to form a band corner portion attached to the floor structure.

10. The tray of claim 9, further comprising a rib formed on an exterior surface of at least one band corner portion, and a platform formed at an upper edge of a corresponding band corner portion for supporting the rib of an adjacent above-nested tray, and wherein an uppermost edge of the corresponding band corner portion is an uppermost surface of the wall structure at the corresponding band corner portion and wherein the upper edge of the band corner portion is below uppermost surfaces of the side and end portions.

11. The tray of claim 6, wherein each column has an inner column surface which projects inward, and an outer column surface of an adjacent below-nested tray.

12. The tray of claim 6, wherein the band has a substantially planar inner surface.

13. A low depth nestable tray for container, having a floor structure with a floor top surface, a floor bottom surface, and a plurality of container support areas on the floor top surface, wherein the improvements comprise:

a low depth wall structure comprising a plurality of columns arranged along the periphery of the floor structure, and further comprising a band having side and end portions spaced above the floor structure and connected to the floor structure by said columns to form a unitary construction, wherein said band is contoured downwardly along the side portions to form a band side detail that directly connects to the floor surface at the side portions of said tray, and wherein an uppermost edge of the band side detail is an uppermost surface of the wall structure at the band side detail and wherein the upper edge of the band side detail at each band side detail is below an uppermost surface of the side and end portions of the band.

14. The tray of claim 13, wherein one of the side portions of the band is contoured downwardly and one of the end portions of the band is contoured downwardly so as to converge together to define a band corner portion.

15. The tray of claim 14, wherein the band corner portion is integrally attached to the floor structure at each corner of the tray.

16. The tray of claim 13, wherein each column each column has an inner column surface which projects inward, and an outer column surface which is recessed inward to receive therein the inner column surface of an adjacent below-nested 17. The tray of claim 13, further comprising a rib formed on an exterior surface of at least one band corner portion, and a platform formed at an upper edge of a corresponding band corner portion for supporting a rib of an adjacent above-nested tray.

18. The tray of claim 13, wherein the band side detail is centrally disposed along the length of the side wall.

19. The tray of claim 1, wherein the band has a substantially planar inner surface.

20. The tray of claim 1, wherein each column has an inner column surface which projects inward, and an outer column surface which is recessed inward to receive therein the inner column surface of an adjacent below-nested tray.

21. The tray of claim 13 wherein said band side detail has a top edge for contacting and supporting a mating bottom edge of the band side detail of a like tray nested thereabove.

22. A low depth nestable tray for containers comprising:

a floor structure with a floor top surface, a floor bottom surface, and a plurality of container support areas on the floor top surface;

a low depth wall structure comprising a plurality of cloumns generally transvers to the floor structure and arranged along the periphyery of the floor structure, and further comprising a band having side and end portions spaced above the floor structure, the band connected to the floor structure by said columns, and wherein theband is contoured downwardly to form a band corner portion that directly connects to the floor structure at each corner of the tray, wherein a top surface of the band at the band corner portion is the uppermost surface of the tray at the band corner portion to contact and support a like tray nested thereabove.

23. The tray of claim 22 wherein parallel portions of the band, generally parallel to the floor structure, extend between at least two of the plurality of columns.

24. The tray of claim 22 wherein the top surface of the band is contoured downwardly to form the band corner portion.

25. The tray of claim 22, further comprising a rib on an exterior surface of each band corner portion, the top surface of each band corner portion positioned to contact and support the rib of the avove nested tray.

26. The tray of claim 22 wherein the band includes side parallel portions and end parallel portions generally perpendicular to the side parallel portions, and wherein each band corner portion is between one of the side parallel portions and one of the end parallel portions.

27. The tray of claim 26 wherein an uppermost surface of the wall structure at each of the band corner portions is disposed below the plane of the parallel portions.

28. The tray of claim 27 wherein an uppermost surface of the band is the uppermost surface of the tray at the parallel portions and at the band conrer portions.

* * * * *

UNITED STATES PATENT AND TRADEMARK OFFICE

CERTIFICATE OF CORRECTION

PATENT NO. : 7,093,715 B1
APPLICATION NO. : 09/780073
DATED : August 22, 2006
INVENTOR(S) : Apps It is certified that error appears in the above-identified patent and that said Letters Patent is hereby corrected as shown below:

IN THE CLAIMS:

In Column 7, Claim 11, Line 47 of the issued patent, please insert --which is recessed inward to receive therein the inner column surface-- after "surface" and before "of".

In Column 8, Claim 16, Line 12 of the issued patent, please insert --tray-- after "below-nested".

In Column 8, Claim 22, Line 34 of the issued patent, "cloumns" should read as --columns--.

In column 8, Claim 22, Line 34 of the issued patent, "transvers" should read as --transverse--.

In Column 8, Claim 22, Line 35 of the issued patent, "periphyery" should read as --periphery--.

In Column 8, Claim 22, Line 39 of the issued patent, "theband" should read as --the band--.

In Column 8, Claim 25, Line 54 of the issued patent, "avove nested" should read as --above-nested--.

Signed and Sealed this

Twelfth Day of December, 2006

JON W. DUDAS
*Director of the United States Patent and Trademark Office*